US009036942B1

(12) United States Patent
Badger et al.

(10) Patent No.: US 9,036,942 B1
(45) Date of Patent: May 19, 2015

(54) LINK BETWEEN HANDHELD DEVICE AND PROJECTILE

(71) Applicant: The United States of America, as represented by the Secretary of the Army, Washington, DC (US)

(72) Inventors: Michael Badger, Ocean Grove, NJ (US); Dennis Bushmitch, Somerset, NJ (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 176 days.

(21) Appl. No.: 13/742,844

(22) Filed: Jan. 16, 2013

(51) Int. Cl.

| | |
|---|---|
| ***F42C 13/04*** | (2006.01) |
| ***F42B 12/42*** | (2006.01) |
| ***F42B 12/48*** | (2006.01) |
| ***F42C 13/00*** | (2006.01) |

(52) U.S. Cl.
CPC ..... *F42C 13/047* (2013.01); *F42B 12/42* (2013.01); *F42B 12/48* (2013.01); *F42C 13/00* (2013.01)

(58) Field of Classification Search
CPC ..... G06T 5/50; G06T 2207/20221; G06T 2207/20092; G06T 7/0097; A61B 6/037; A61B 6/5247; A61B 6/463; A61B 8/14; A61B 8/463; A61B 19/203; A61B 19/2203; A61B 19/52; A61B 19/5244; A61B 1/00009; F42C 13/04
USPC ..... 382/284; 102/487
See application file for complete search history.

(56) References Cited

U.S. PATENT DOCUMENTS

| | | | | |
|---|---|---|---|---|
| 3,962,537 | A | 6/1976 | Kearns et al. | |
| 4,552,533 | A * | 11/1985 | Walmsley | 434/12 |
| 6,119,976 | A | 9/2000 | Rogers | |
| 6,244,535 | B1 * | 6/2001 | Felix | 244/3.16 |
| 6,380,889 | B1 | 4/2002 | Herrmann et al. | |
| 6,761,117 | B1 | 7/2004 | Benz | |
| 6,924,838 | B1 | 8/2005 | Nieves | |
| 6,978,717 | B1 | 12/2005 | Hambric | |
| 7,373,849 | B2 | 5/2008 | Lloyd et al. | |
| 7,437,985 | B2 | 10/2008 | Gal | |
| 7,631,601 | B2 | 12/2009 | Feldman et al. | |
| 7,679,037 | B2 | 3/2010 | Eden et al. | |
| 7,861,656 | B2 * | 1/2011 | Thomas et al. | 102/487 |
| 2008/0293488 | A1 | 11/2008 | Cheng et al. | |
| 2010/0014780 | A1 * | 1/2010 | Kalayeh | 382/284 |
| 2010/0313741 | A1 * | 12/2010 | Smogitel | 89/1.11 |
| 2014/0062754 | A1 * | 3/2014 | Mohamadi | 342/22 |

OTHER PUBLICATIONS

BBC News, Grenade camera to aid UK troops, http://news.bbc.co.uk/2/hi/technology/7734038.stm, Nov. 18, 2008, 2 pages.

* cited by examiner

*Primary Examiner* — Jingge Wu
(74) *Attorney, Agent, or Firm* — Azza Jayaprakash

(57) ABSTRACT

A projectile can be equipped with a camera and be configured to detonate after receiving a command to detonate. After the projectile is thrown the camera can capture images. These images can be sent by way of the physical link to the handheld device. The handheld device can display the images. A user of the handheld device can view the images and determine if the projectile should detonate based on the images.

20 Claims, 14 Drawing Sheets

LINK BETWEEN HANDHELD DEVICE AND PROJECTILE

GOVERNMENT INTEREST

The innovation described herein may be manufactured, used, imported, sold, and licensed by or for the Government of the United States of America without the payment of any royalty thereon or therefor.

BACKGROUND

In a combat setting, a warfighter can identify an enemy target. This enemy target can be considered a threat to the warfighter and in view of this threat the warfighter can make a decision to attempt to eliminate the threat. Various weapons can be used to eliminate the threat. For example, a shrapnel grenade can be used to eliminate the threat. The shrapnel grenade can have a pin in place that stops the shrapnel grenade from activating. When the pin is pulled, a timer of the shrapnel grenade can activate unless the timer is manually paused or the pin is replaced. The warfighter can throw the shrapnel grenade and the shrapnel grenade can detonate after the timer expires. The goal can be for the timer to expire when the shrapnel grenade reaches the threat such that the threat is subjected to the shrapnel.

SUMMARY

A system comprising an access component, a stitch component, a display, an interface, an analysis component a determination component, and a causation component is described. The access component is configured to access a plurality of images, where the plurality of images are collected from a projectile by way of a physical link. The stitch component is configured to produce a composite image from the plurality of images, where the composite image is of a higher resolution level than a resolution level of individual images of the plurality of images. The display is configured to display the composite image while the interface is configured to receive an input after the display displays the composite image. The analysis component is configured to perform an analysis of the input The determination component is configured to make a determination on if the input is an instruction to cause an ordnance of the projectile to explode, where the determination is based, at least in part, on a result of the analysis. The causation component is configured to cause the ordnance of the projectile to explode in response to the input being the instruction to cause the ordnance of the projectile to explode.

A system comprising a detonation component and an image acquisition component is described. The detonation component is configured to cause an ordnance to detonate. The image acquisition component is configured to cause a capture of a plurality of images, where the detonation component and the image acquisition component are retained in a housing and where the housing is tethered to a handheld device by way of a physical link.

A handheld device comprising a display, an interface, a processor, and a computer-readable medium is described. The display is configured to display a compound image, where the compound image is an image stitched from a plurality of images, where the compound image is of a higher resolution level then a resolution level of individual images of the plurality of images and where the plurality of images are obtained from an grenade tethered by a physical link to the handheld device. The interface is configured to obtain an input while the computer-readable medium is configured to store computer-executable instructions that when executed by the processor cause the processor to perform a method. The method comprises performing an analysis of the input; making a determination on if the input is an instruction to cause an ordnance of the grenade to detonate, where the determination is based, at least in part, on a result of the analysis; and causing the ordnance of the grenade to detonate in response to the input being the instruction to cause the ordnance of the grenade to detonate.

BRIEF DESCRIPTION OF THE DRAWINGS

Incorporated herein are drawings that constitute a part of the specification and illustrate embodiments of the detailed description. The detailed description will now be described further with reference to the accompanying drawings as follows.

DETAILED DESCRIPTION

Figure 1:
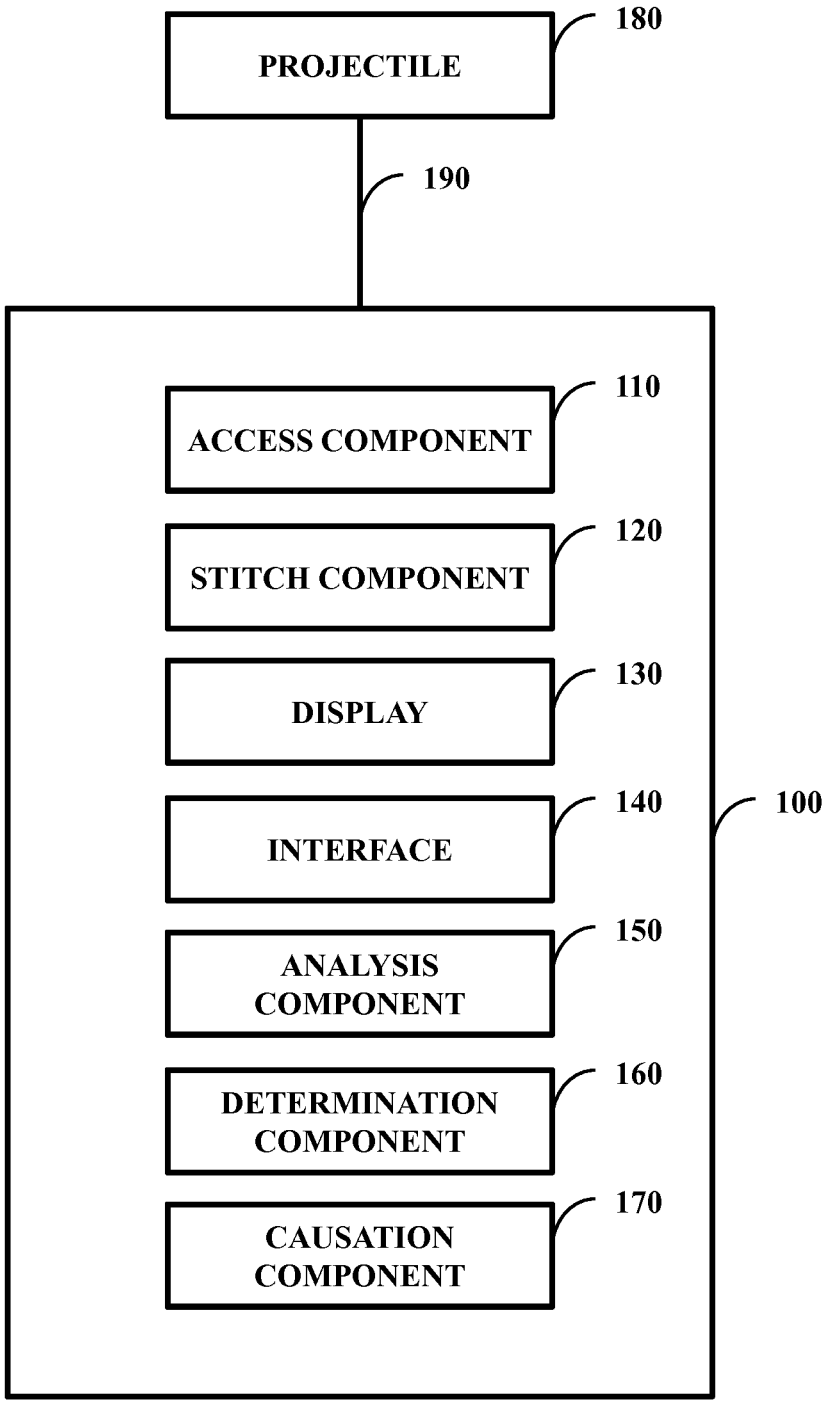
FIG. 1 illustrates one embodiment of system comprising an access component, a stitch component, a display, an interface, an analysis component, a determination component, and a causation component.

Systems, methods and other embodiments disclosed herein are related to a physical link between a handheld device and a projectile. The projectile can be a grenade (e.g., concussion grenade) and the grenade can be used in a modern combat operation. In an example of a modern combat operation multiple combat teams of several members each can attempt to eliminate threats in a large building. The multiple combat teams can enter the large building from different points of entry and attempt to systematically enter rooms to eliminate threats. Due to various factors, such as darkness, noise, limited operational intelligence, and heightened senses the work performed by the multiple combat teams can be difficult, confusing, and dangerous.

For example, a first combat team can enter from a west entry point and a second combat team can enter from an east entry point. These combat teams can progressively go through rooms attempting to identify and eliminate threats. One way to identify and eliminate threats is to throw a concussion grenade in a room and after the concussion grenade detonates a combat team enters the room. This method has multiple drawbacks. A first drawback is that the concussion grenade is wasted if the room does not have any target inside. A second drawback is that friendly forces may be inside the room and as such the friendly forces become concussed causing them to be temporarily ineffective or have mild to severe injuries. For example, unbeknown to one another, the first combat team and the second combat team can be in adjoining rooms in the large building. The first combat team can throw the concussion grenade in the room of the second combat team and the concussion grenade can detonate after a timer expires. Thus, the second combat team is subjected to the concussion grenade.

To alleviate unintentional subjection to a projectile such as the concussion grenade, the projectile can be equipped with a camera and be configured to detonate after receiving a command to detonate. After the projectile is thrown the camera can capture images. These images can be sent by way of the physical link to the handheld device. The handheld device can display the images. A user of the handheld device can view the images and determine if the projectile should detonate based on the images. Returning to the example in the previous paragraph, the concussion grenade can have a camera that sends images along a physical link to a handheld device. If the first combat team throws the concussion grenade in the room with the second combat team, then a user of the handheld device can identify that the second combat team is in the room and not cause the concussion grenade to detonate. Therefore, the second combat team would not be subject to the concussion grenade.

The following includes definitions of selected terms employed herein. The definitions include various examples. The examples are not intended to be limiting.

"One embodiment", "an embodiment", "one example", "an example", and so on, indicate that the embodiment(s) or example(s) can include a particular feature, structure, characteristic, property, or element, but that not every embodiment or example necessarily includes that particular feature, structure, characteristic, property or element. Furthermore, repeated use of the phrase "in one embodiment" may or may not refer to the same embodiment.

"Computer-readable medium", as used herein, refers to a medium that stores signals, instructions and/or data. Examples of a computer-readable medium include, but are not limited to, non-volatile media and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, other optical medium, a Random Access Memory (RAM), a Read-Only Memory (ROM), a memory chip or card, a memory stick, and other media from which a computer, a processor or other electronic device can read. In one embodiment, the computer-readable medium is a non-transitory computer-readable medium.

"Component", as used herein, includes but is not limited to hardware, firmware, software stored on a computer-readable medium or in execution on a machine, and/or combinations of each to perform a function(s) or an action(s), and/or to cause a function or action from another component, method, and/or system. Component may include a software controlled microprocessor, a discrete component, an analog circuit, a digital circuit, a programmed logic device, a memory device containing instructions, and so on. Where multiple components are described, it may be possible to incorporate the multiple components into one physical component or conversely, where a single component is described, it may be possible to distribute that single logical component between multiple components.

"Software", as used herein, includes but is not limited to, one or more executable instructions stored on a computer-readable medium that cause a computer, processor, or other electronic device to perform functions, actions and/or behave in a desired manner. The instructions may be embodied in various forms including routines, algorithms, modules, methods, threads, and/or programs including separate applications or code from dynamically linked libraries.

FIG. 1 illustrates one embodiment of system 100 comprising an access component 110, a stitch component 120, a display 130, an interface 140, an analysis component 150, a determination component 160, and a causation component 170.

The access component 110 is configured to access a plurality of images, where the plurality of images is collected from a projectile 180 by way of a physical link 190. The projectile 180 can be equipped with a camera to capture the plurality of images (e.g., two or more images) or a single image. The plurality of images can be transferred from the projectile 180 to the system 100 over the physical link 190. The access component 110 can function as a collection component that receives the plurality of images from the physical link 190. The access component 110 can be a passive component that collects the plurality of images or an active component that performs processing on the plurality of images (e.g., improving contrast ratio, color space correction, etc.). As an example of an active component, the plurality of images can be sent in a compressed file format (e.g., compressed by a component of the projectile 180) and the access component 110 can decompress the plurality of images once received.

The stitch component 120 is configured to produce a composite image from the plurality of images. In one example, the projectile 180 can be rolled into a room and as the projectile 180 rolls the projectile 180 can capture the plurality of images. Further, the projectile 180 can have multiple cameras that are pointed in different directions. These multiple cameras can capture the plurality of images and the stitch component 120 can create a composite image that is a panoramic view of an area. In one embodiment, the stitch component 120 can being image stitching as individual images of the plurality of images arrive. For example, the access component 110 can collect a first image and a second image of the plurality of images. The stitch component 120 can stitch together the first image and the second image into a composite image while a third image of the plurality of images is being collected. Once the third image is collected or once the first image and second image are stitched together, the third image can be stitched into the composite image. In one embodiment, the first image is taken at a first point in time, the second image is taken at a second point in time after the first point in time, and the third image is taken at a third point in time after the second point in time. The stitch component 120 can stitch the first image with the third image to form the composite image. The stitch component 120 can improve the composite image by stitching in the second image. In one embodiment, the composite image is of a higher resolution level than a resolution level of individual images of the plurality of images.

The display 130 is configured to display the composite image (e.g., at least part of the composite image) and the interface 140 is configured to receive an input after the display 130 displays the composite image. The display 130 (e.g., a screen) and the interface 140 (e.g., graphical user interface of the display 130, hardware keypad, etc.) can be used together. The display 130 can provide notice that the composite image can be viewed and give an instruction of a key to press on the interface 140 to cause the composite image to be displayed upon the interface 140. When the key is pressed the display 130 displays the composite image. The interface 140 can be used to change how the composite image is displayed upon the display 130. For example, the interface 140 can include keys for zooming in or out for the composite image, panning the composite image, and others. In one embodiment, the interface 140 is part of the display 130 (e.g., the interface is part of a touch screen that is the display 130).

The analysis component 150 is configured to perform an analysis of the input of the interface 140 and the determination component 160 is configured to make a determination on if the input is an instruction to cause an ordnance of the projectile 180 to explode. The determination can be based, at least in part, on a result of the analysis. The causation component 170 is configured to cause the ordnance of the projectile 180 to explode in response to the input being the instruction to cause the ordnance of the projectile 180 to explode. The instruction can be produced by an operator (e.g., by way of the interface 140) or be proactively (e.g., automatically) generated.

For example, a user can view the composite image that is presented on the display 130 and make an identification that the projectile 180 is near a threat. Based on this identification, the user can press a button on the interface 140 for the ordnance of the projectile 180 to detonate. The analysis component 150 identifies that the button is pressed (e.g., identifies what button is pressed) and the determination component 160 determines a function associated with the pressed button (e.g., an instruction to cause the ordnance to explode). When the determination component 160 determines that the button to cause the ordnance to explode is pressed the causation component 170 can function to cause the ordnance of the projectile 180 to explode. For example, this can be done by sending an electronic impulse from the system 100 to the projectile 180 along the physical link 190. The electronic impulse from the causation component 170 can cause the ordnance to detonate upon receipt.

Figure 2:
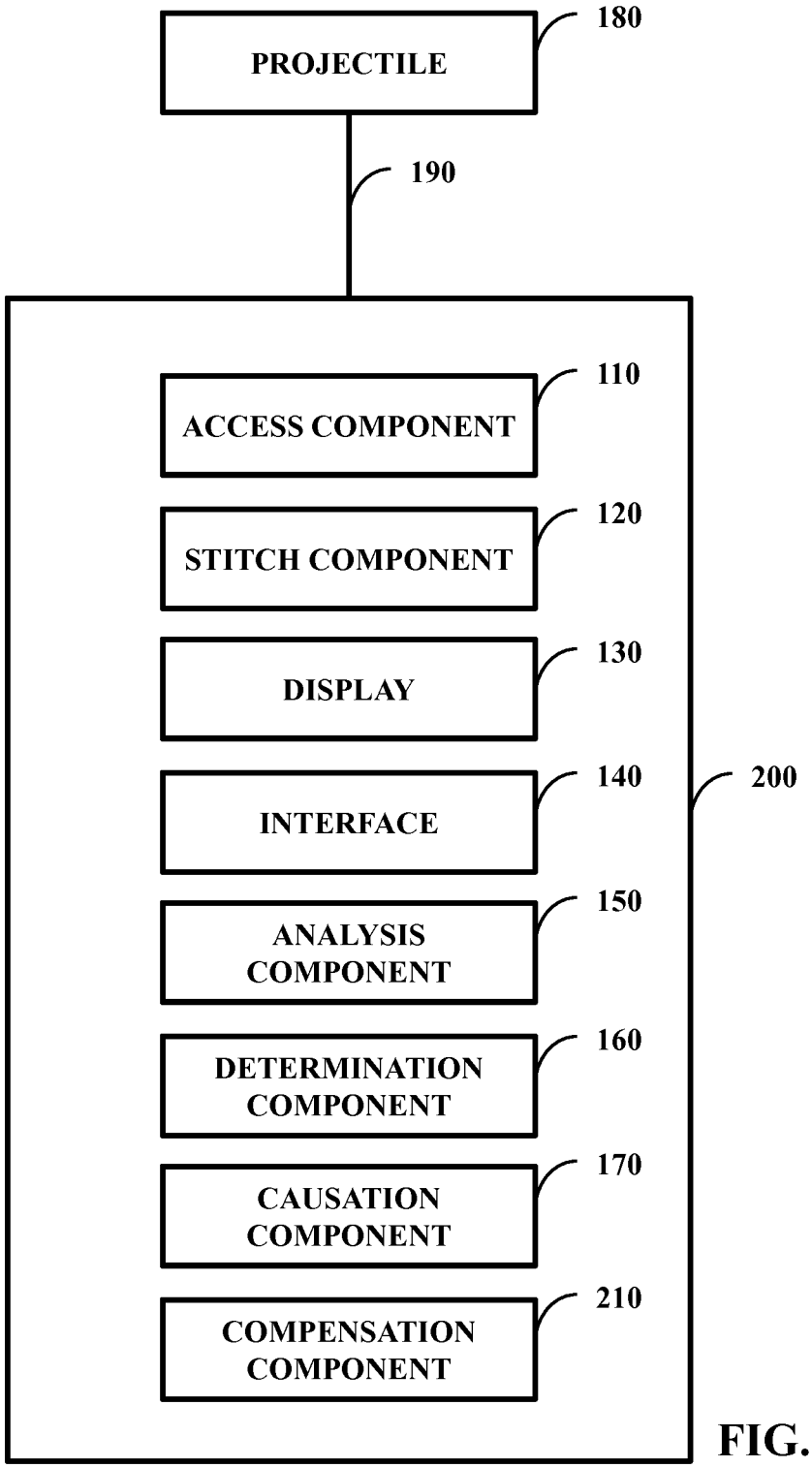
FIG. 2 illustrates one embodiment of system comprising the access component, the stitch component, the display, the interface, the analysis component, the determination component, the causation component, and a compensation component.

FIG. 2 illustrates one embodiment of system 200 comprising the access component 110, the stitch component 120, the display 130, the interface 140, the analysis component 150, the determination component 160, the causation component 170, and a compensation component 210.

The compensation component 210 is configured to produce a compensation factor for a difference between how a first image of the plurality of images is captured and how a second image of the plurality of images is captured. The compensation factor assists image stitching functionality, such as by incorporating information about the movement of the projectile and other environmental factors. The stitch component 120 is configured to produce the composite image through performance of a stitch of the first image together with the second image where performance of the stitch comprises use of the compensation factor. It is to be appreciated by one of ordinary skill in the art that while discussion is made of the compensation factor regarding two images, the compensation factor can be used in stitching multiple images.

In one example with regard to the compensation factor, the first image can be taken at a first point in time and the second image can be taken at a second point in time. The target can make a movement between the first moment in time and the second moment in time. This movement can cause difficulty in stitching the first image and the second image together since the target is in different locations and/or positions among the images. The compensation component 210 can create a compensation factor based on this movement, where the movement can be mathematically determined by an accelerometer (e.g., built into the projectile 180). Examples of the compensation factor can include modifying an image, applying a mathematical formula to the images (e.g., where the mathematical formula modifies pixel values), making an estimate, etc.

In one example with regard to the compensation factor, the projectile 180 can be thrown into a room and while the projectile 180 travels (e.g., in flight, after touching ground, etc.) images can be captured of the room. Due to changes from when images are captured (e.g., changes in altitude due to the throw) the compensation factor can be produced and used to compensate for those changes. Multiple compensation factors can be used and the multiple compensation factors can be used in producing the composite image.

Figure 3:
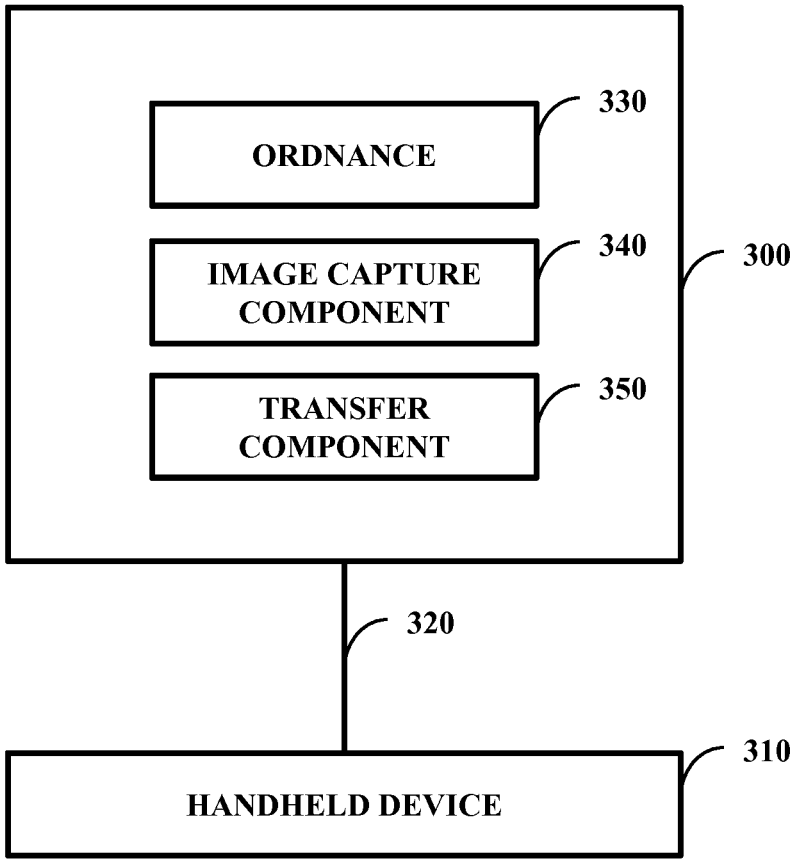
FIG. 3 illustrates one embodiment of an explosive ordnance device connected to a handheld device by way of a physical link, the explosive ordnance device comprising an ordnance, an image capture component, and a transfer component.

FIG. 3 illustrates one embodiment of an explosive ordnance device 300 connected to a handheld device 310 by way of a physical link 320 (e.g., the physical link 190 of FIG. 1), the explosive ordnance device 300 comprising an ordnance 330, an image capture component 340, and a transfer component 350. The explosive ordnance device 300 can include other components as well, such as a motion information obtainment component (e.g., an accelerometer) or a gyroscope-based navigational/movement component.

The projectile 180 of FIG. 1 can be the explosive ordnance device 300 that is linked to the handheld device 310. The handheld device 310 can be a smart phone, a laptop computer, a specifically designed device, or other device. The handheld device 310 can supply power to the explosive ordnance device 300 by way of the physical link 320 and/or retain a power supply. Components of the system 100 of FIG. 1 and/or the system 200 of FIG. 2 can be part of the handheld device 310 (e.g., the access component 110 of FIG. 1 is part of the handheld device 310, the stitch component 120 of FIG. 1 is part of the handheld device 310, the analysis component 150 of FIG. 1 is part of the handheld device 310, the determination component 160 is part of the handheld device 310, and the causation component 170 is part of the handheld device 310). The interface 130 of FIG. 1 and the display 140 of FIG. 1 can be part of the handheld device 310. The physical link 320 can be a tether between the explosive ordnance device 300 and the handheld device 310 (e.g., used to retrieve the explosive ordnance device 300).

The explosive ordnance device 300 can be equipped with the image capture component 340 that is configured to cause capture of the plurality of images. In one embodiment, the image capture component 340 is a single fixed camera. In one embodiment, the image capture component 340 is a single camera that is moveable (e.g., from command of the interface 140 of FIG. 1). In one embodiment, the image capture component 340 is multiple cameras (e.g., fixed and/or movable) that take images concurrently or at different times. In one embodiment, the image capture component 340 is at least one infrared sensor that captures at least one heat-based image that is part of the plurality of images.

The explosive ordnance device 300 uses the transfer component 350 to send the plurality of images from the explosive ordnance device 300 to the handheld device 310 (e.g., along the physical link 320). The access component 110 of FIG. 1 (e.g., that is part of the handheld device 310) is configured to collect the plurality of images sent by the transfer component 350. The transfer component 350 can send metadata about the plurality of images (e.g., additional information about the images, such as time taken or exposure length) obtained by the explosive ordnance device 300 to the handheld device 310. The handheld device 310 can display the metadata (e.g., by way of the display 130 of FIG. 1), use the metadata in creating the composite image, etc.

Figure 4:
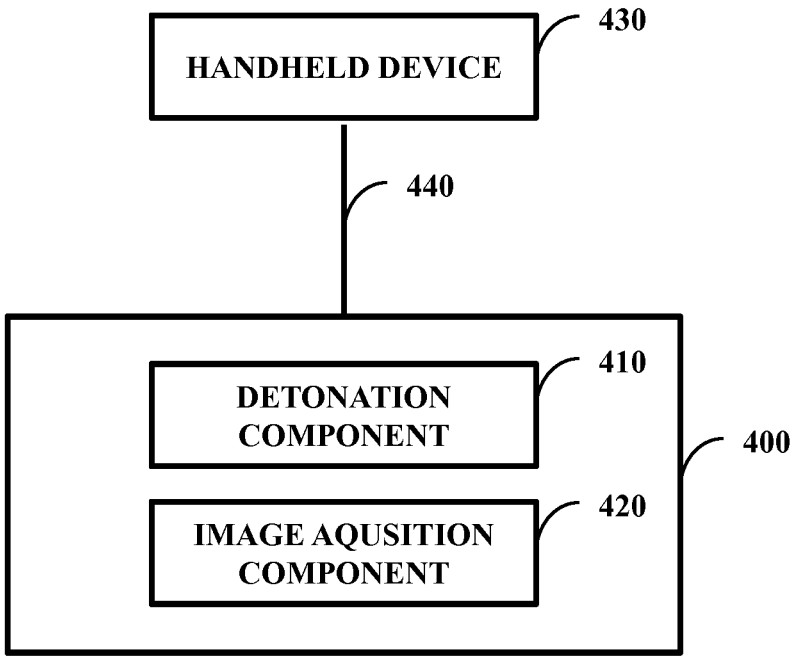
FIG. 4 illustrates one embodiment of a system comprising a detonation component and an image acquisition component, where the system is tethered to a handheld device by way of a physical link.

FIG. 4 illustrates one embodiment of a system 400 comprising a detonation component 410 and an image acquisition component 420, where the system is tethered to a handheld device 430 (e.g., the handheld device 310 of FIG. 3) by way of a physical link 440. It is to be appreciated that while the physical link 440 is discussed, aspects disclosed herein can be practiced with a different link type (e.g., wireless link). In addition, the system 400 can be configured for a replaceable link (e.g., replace the physical link 440 with a wireless link).

The system 400 is an example of the projectile 180 of FIG. 1. The projectile 180 of FIG. 1 can include an ordnance (e.g., lethal weapon payload, smoke payload, concussion payload, sound wave emitter payload, etc.) and the detonation component 410 can be configured to cause the ordnance to detonate (e.g., in response to receiving a command from the causation component 170 of FIG. 1).

In one embodiment, the detonation component 410 functions in response to a command from the handheld device 430. The handheld device 430 can display a stitched image derived from a plurality of images and based on the stitch image a user can cause the handheld device 430 to send the command to the detonation component 410. The image acquisition component 420 is configured to cause a capture of the plurality of images.

The detonation component 410 and the image capture component 420 (e.g., a camera) are retained in a housing (e.g., the projectile 180 of FIG. 1). The housing is tethered to the handheld device 430 by way of the physical link 440 (e.g., optical fiber, conducting wire, etc.). The housing can also retain the ordnance (e.g., ordnance 330 of FIG. 3), where the plurality of images (e.g., still images, video images) are sent from the housing to the handheld device 430 by way of the physical link 440. Sending the plurality of images over the physical link 440 can lower jamming susceptibility and lower a likelihood of detection (e.g., if wireless communication is not used). Individual images of the plurality of images can be visual images, infrared images, night-vision images, etc. In one embodiment, the plurality of images cover an area of about 360 degrees around the housing. The handheld device 430 can be configured to perform an image stitch of the plurality of images to create a composite image (e.g., by way of the stitch component 120 of FIG. 1). In one embodiment, the stitch component 120 of FIG. 1 is retained by the housing and the composite image is sent from the housing to the handheld device 430 along the physical link 440. In one embodiment, the composite image covers the area of about 360 degrees around the housing.

In one embodiment, the plurality of images, from which the composite image is derived, are captured by use of a light illumination. The light illumination is of a level sufficient to cause at least partial visual impairment to a person. For example, the housing can be thrown into a room and when a condition is met (e.g., once movement of the housing stops) light illumination can occur that blinds a target. Therefore, the housing can be used as a flash grenade. The housing can be outfitted with multiple ordnance types, such as flash, smoke, concussion, shrapnel, strong sound emitter, and others. In one example, the light illumination is initially used to blind a target and also used to provide lighting for image capturing. Images captured by way of this image capturing can be stitched together (e.g., at the housing, at the handheld device 430, etc.) and presented on a display of the handheld device 430. Stitching can occur when a condition is met (e.g., when a certain reading is measured by an accelerometer of the housing). Upon viewing this image a user can decide to enter an area where the target is located and where light illumination occurs (e.g., since a target may be blinded) and/or a command can be sent from the handheld device 430 to have another function occur after light illumination (e.g., a concussion ordnance can detonate). Thus, the housing can retain more than one ordnance type (e.g., flash and concussion) that can be caused to be detonated by the detonation component 410.

Figure 5:
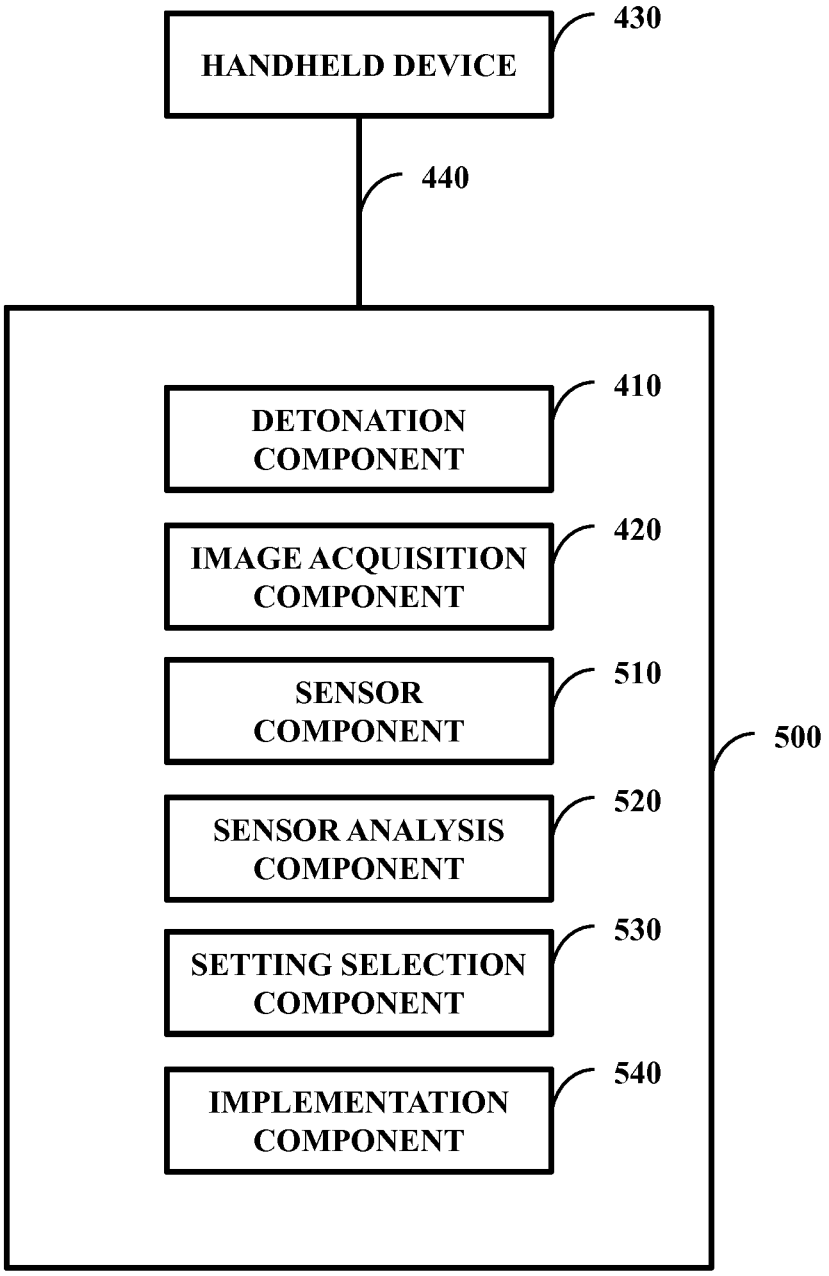
FIG. 5 illustrates one embodiment of a system comprising the detonation component, the image capture component, a sensor component, a sensor analysis component, a setting selection component, and an implementation component.

FIG. 5 illustrates one embodiment of a system 500 comprising the detonation component 410, the image capture component 420, a sensor component 510, a sensor analysis component 520, a setting selection component 530, and an implementation component 540.

The sensor component 510 (e.g., a sensor), that can be retained by the housing, is configured to obtain a contextual information set (a set of information different from the actual images), where the contextual information set is information about surroundings of the housing after deployment of the housing (e.g., after the housing is thrown towards a threat). In one embodiment, the contextual information set is sent across the physical link 440 to the handheld device 430 and presented on a display of the handheld device 430 (e.g., the display 130 of FIG. 1).

The sensor analysis component 520 is configured to analyze the contextual information set to produce a sensor analysis result. The setting selection component 530 is configured make a selection of a setting set for the image capture component 420, where the selection of the setting set is based, at least in part, on the sensor analysis result. The implementation component 540 is configured to cause the capture of the plurality of images to occur in accordance with the setting set.

In one example, the sensor component 510 can obtain distance and lighting data in an area upon which the housing is thrown. The sensor analysis component 520 can evaluate the distance and lighting data and based on this evaluation the setting selection component 530 selects the setting set. Regarding the distance data, the sensor analysis component 520 identifies a distance between the housing and the target. The setting selection component 530 selects a focus level based on the distance identified (e.g., selects a focus level for optimal image quality). Regarding the lighting data, the sensor analysis component 520 determines if a lighting level (determined from the lighting data) is sufficient to capture visual images. If not, then the setting selection component 530 selects a flash level to be used in capturing the plurality of images and the implementation component 540 causes light illumination to occur in accordance with the flash level.

In one embodiment, using the flash (or another feature such as a laser range finder) can be overridden automatically or by user command. For example, if the housing is deployed in an area where the target does not know another force is nearby, then the flash can be disabled so as not to alert the target. This disabling can be through a user command to not use the flash, a lack of command to enable the flash, an inference drawn by the housing (e.g., how the housing is deployed), etc. When lighting is desirable yet not feasible due to contextual circumstances (e.g., a covert operation is being performed) the image acquisition component 420 can capture the plurality of images without flash and less than optimal composite image can be produced since optimal light was not used (e.g., with optimal being with using flash).

Figure 6:
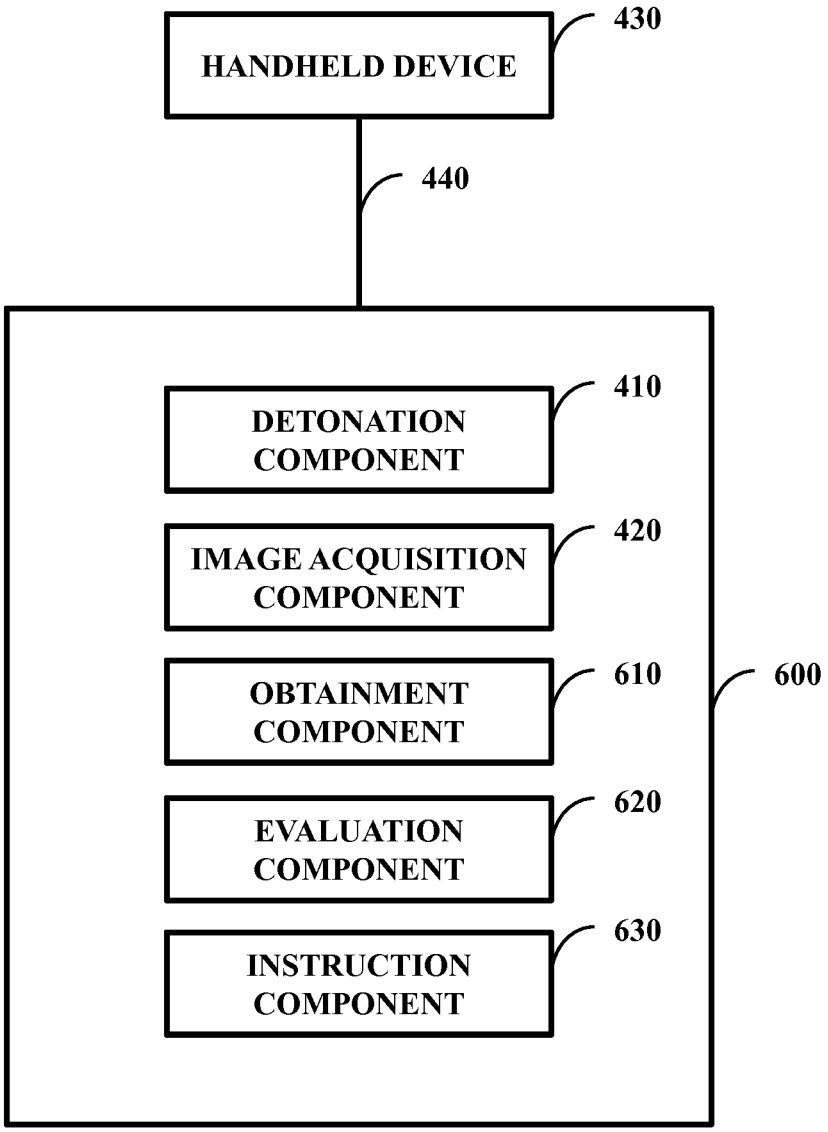
FIG. 6 illustrates one embodiment of a system comprising the detonation component, the image acquisition component, an obtainment component, an evaluation component, and an instruction component.

FIG. 6 illustrates one embodiment of a system 600 comprising the detonation component 410, the image acquisition component 420, an obtainment component 610, an evaluation component 620, and an instruction component 630.

The housing can retain the obtainment component 610, the evaluation component 620, and the instruction component 630. The obtainment component 610 is configured to obtain an operator instruction from the handheld device 430 by way of the physical link 440. In one embodiment, the operator instruction is entered by way of the interface 140 of FIG. 1. The evaluation component 620 is configured to perform an evaluation of the operator instruction. The instruction component 630 is configured to make a determination on if the operator instruction is to cause the ordnance to detonate, where the determination is based, at least in part, on a result of the evaluation. The detonation component 410 is configured to cause the ordnance to detonate in response to the determination being that the operator instruction is to cause the ordnance to detonate.

Figure 7:
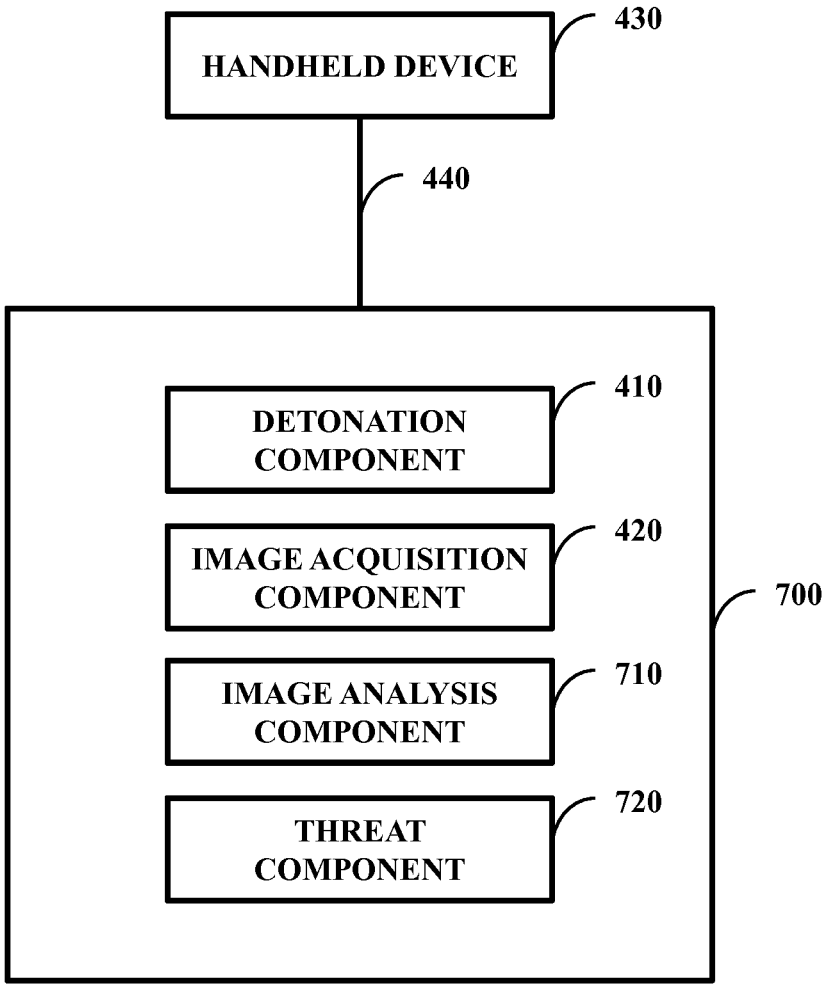
FIG. 7 illustrates one embodiment of a system comprising the detonation component, the image acquisition component, an image analysis component, and a threat component.

FIG. 7 illustrates one embodiment of a system 700 comprising the detonation component 410, the image acquisition component 420, an image analysis component 710, and a threat component 720. The image analysis component 710 and the threat component 720, as well as other components disclosed herein, can be part of the projectile 180 of FIG. 1, the handheld device 310 of FIG. 3, and others.

The image analysis component 710 is configured to analyze the plurality of images (e.g., obtained by the image acquisition component 420) and/or the composite image to produce an analysis result. The threat component 720 is configured to proactively (e.g., automatically) make a determination on if the detonation component 410 should cause the ordnance to detonate based, at least in part, on the analysis result. The detonation component 410 causes the ordnance to detonate in response to the determination being that the detonation component 410 should cause the ordnance to detonate.

For example, the system 700 is connected to the handheld device 430 by way of the physical link 440. The composite image can be generated, but with a less than ideal quality level. A user can view the composite image and see a human figure. Based on viewing this human figure, the user can give a user instruction to detonate the ordnance. However, in viewing the human figure, the user can mistakenly identify the human figure as a threat where the human figure can be a friendly force. Therefore, following user instruction can cause an accident in that the ordnance detonates toward a friendly force.

The image analysis component 710 and the threat component 720 can work together to prevent the accident from occurring. The image analysis component 710 analyzes the plurality of images and/or the composite image and based on this analysis a determination is made that the human figure is a friendly force with a certainty level above a threshold level. In one example, this analysis can include viewing of image pixels of a patch on a uniform of the human figure. While the patch may not be visible to the human eye, the analysis can result in a determination that the patch is a patch likely to be worn by a friendly force and not worn by a threat. Based on this determination, the system 700 can override the user instruction to detonate the ordnance. The system 700 can send a message as to why the override occurs (e.g., the message is displayed on the interface 140 of FIG. 1). In one embodiment, the user can supersede the override and cause the ordnance to detonate while in one embodiment the user can be prevented from superseding the override. In short, final authorization for use of the detonation component 410 can reside with the system 700 (e.g., detonation does not occur regardless of a command from the handheld device 430) or with the handheld device 430 (e.g., a user can give final authorization that overrides a decision of the system 700).

Figure 8:
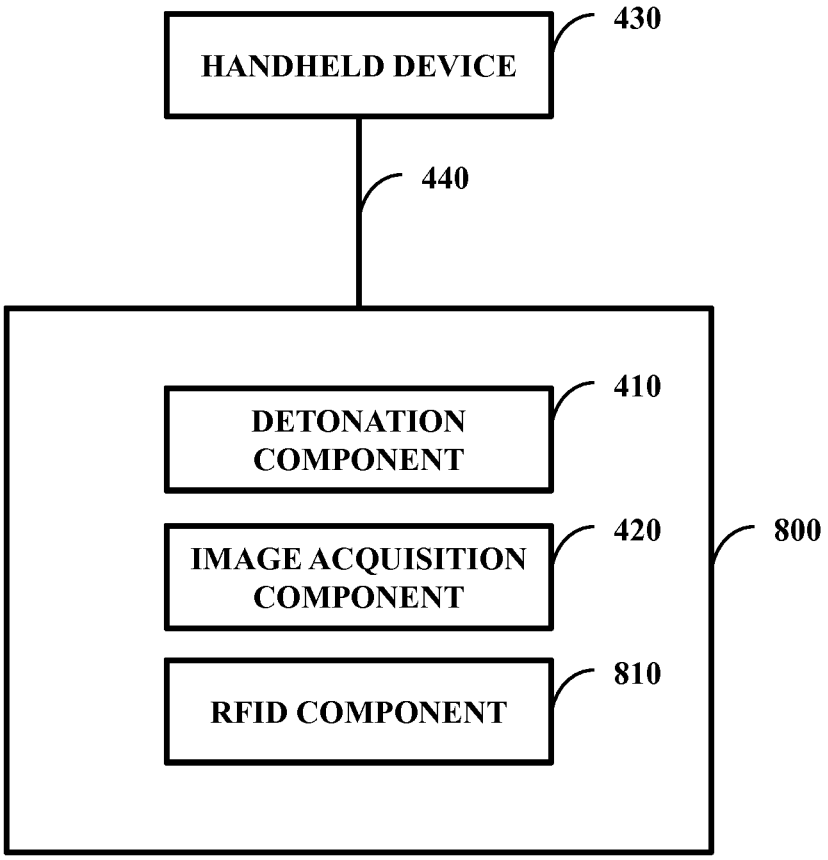
FIG. 8 illustrates one embodiment of a system comprising the detonation component, the image acquisition component, and a radio frequency identifier (RFID) component.

FIG. 8 illustrates one embodiment of a system 800 comprising the detonation component 410, the image acquisition component 420, and a radio frequency identifier (RFID) component 810.

The RFID component 810 is configured to identify a radio frequency information set, evaluate the radio frequency information set to produce an evaluation result, and make a determination on if the ordnance should detonate based, at least in part, on the evaluation result. The detonation component 410 can cause the ordnance to detonate in response to the determination being that the ordnance should detonate.

In one embodiment, the RFID component 810 is configured to prevent the detonation component 410 from causing the ordnance to detonate when a detonation instruction is identified for the ordnance and when the determination is that the ordnance should not detonate. It can be beneficial to have a check-and-balance configuration to stop accidental detonation of the ordnance (e.g., by employing image analysis as discussed with FIG. 7). Use of a radio frequency identifier can function as part of this check-and-balance configuration.

For example, the system 800 can be part of a flash grenade. The flash grenade can be thrown into a room where a user of the handheld device 430 is not located. The image acquisition component 420 captures images and sends these images along the physical link 440. The images are stitched together and displayed (e.g., on the handheld device 430). A person can be identified in the room by a user and the user can send a command from the handheld device 430 for the ordnance to detonate. The command can travel along the physical link 440 to the flash grenade and in turn the system 800. The person can have an RFID device that indicates that they are friendly. Since the command may be an error (e.g., detonate the flash grenade nearby a friendly person), the RFID component 810 can stop the command from being followed. In one embodiment, an indication can be displayed on the handheld device 430 as to why detonation does not occur and/or the handheld device 430 can be able to override this command stop.

In one embodiment, the radio frequency information set is that a person without an authorized RFID tag is handling the ordnance. In this embodiment, the determination is that the ordnance should detonate because the person without the authorized radio frequency identification tag is handling the ordnance. The ordnance can be part of a shrapnel grenade that is thrown toward a target. The target can attempt to disarm the shrapnel grenade or attempt to throw the shrapnel grenade to a place of origin or other location. Either of these situations can be seen as undesirable from the perspective of a user throwing the shrapnel grenade. Therefore, if the shrapnel grenade is handled by someone without an RFID tag (e.g., after a length of time after a pin is removed), then the shrapnel grenade can detonate. However, if the shrapnel grenade is handheld by a friendly force with an RFID tag, then it can be desirable for detonation in response to the handling to be stopped. Therefore, the system 800 can function to determine if a handler has an RFID tag (e.g., indicating that the handler is a friendly force). If the handler has a RFID tag, then detonation does not occur; otherwise, the shrapnel grenade detonates.

The system 800 can connect to the handheld device 430 by way of the physical link 440 and a command can be received by the system 800 from the handheld device 430 to override detonation stoppage. For example, RFID tags used by a friendly unit can have individual identifiers. A specific RFID tag can be stolen and used by an enemy soldier. When the enemy soldier handles a housing with the system 800 (e.g., the housing retains the ordnance), the specific RFID tag can be identified (e.g., by a component of the system 800, by the handheld device 430, by a combination thereof, etc.). The handheld device 430 can display a number of the specific RFID tag and/or an indication that the tag is stolen. Based on this information, a user of the handheld device 430 can cause the ordnance to detonate (e.g., send a command that overrides a normal stop of such a command) by sending a command to the detonation component 410 that the detonation component 410 follows.

Figure 9:
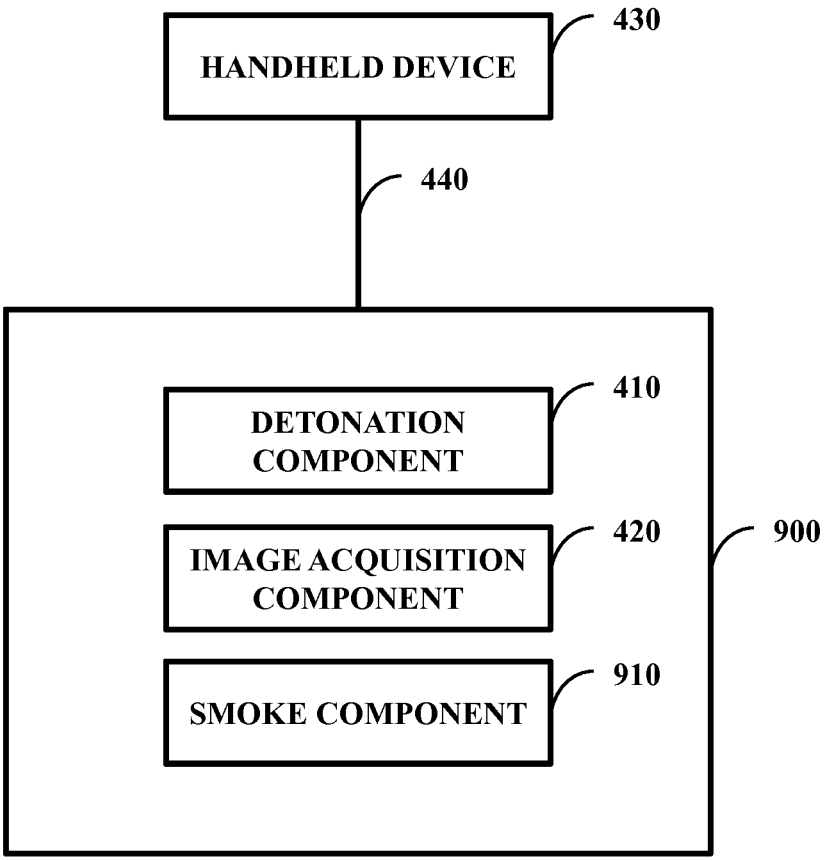
FIG. 9 illustrates one embodiment of a system comprising the detonation component, the image acquisition component, and a smoke component.

FIG. 9 illustrates one embodiment of a system 900 comprising the detonation component 410, the image acquisition component 420, and a smoke component 910.

The smoke component 910 is configured to cause a smoke to be produced, where the image acquisition component 420 is configured to cause the capture of the plurality of images after the smoke is produced. The image acquisition component 420 can be configured to cause the capture of the plurality of images through a non-visual capture technique. The housing retains the detonation component 410, the image acquisition component 420, the smoke component 910, and the ordnance.

In one embodiment, the plurality of images are captured by way of a thermal image technique within a frequency range that is not substantially interfered with by the smoke or captured by way of another non-visual image capture technique. Thermal images can be sent to the handheld device 430 along the physical link 440 and be stitched into a composite image at the handheld device 430 (or at the system 900). The stitched image is displayed on the display 130 of FIG. 1 and a user can make a decision from viewing the stitched image (e.g., decide to enter a room, decide to send an electrical pulse, etc.). This decision can be to send a neutralize command (e.g., stop detonation from being possible) to the detonation component 410.

Figure 10:
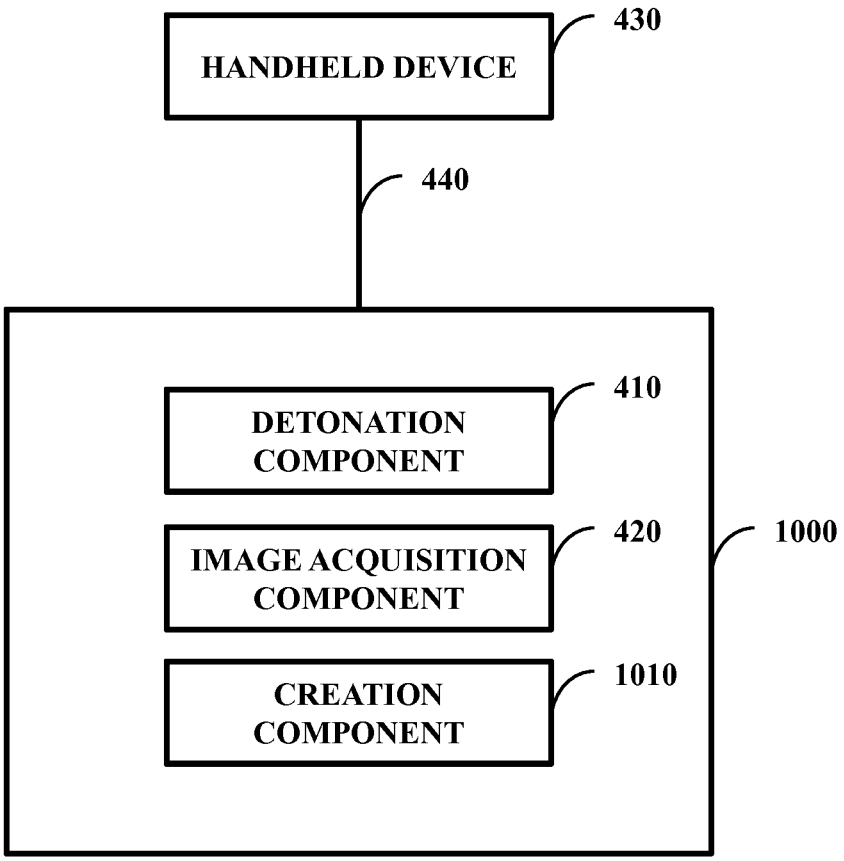
FIG. 10 illustrates one embodiment of a system comprising the detonation component, the image acquisition component, and a creation component.

FIG. 10 illustrates one embodiment of a system 1000 comprising the detonation component 410, the image acquisition component 420, and a creation component 1010.

The creation component 1010 is configured create the composite image, where the housing retains the creation component 1010 along with the detonation component 410 and the image acquisition component 420. In one embodiment, the creation component 1010 employs an algorithm to create the composite image, where the algorithm is configured to manipulate at least one individual image of the plurality of images to produce a manipulated image set (e.g., at least one manipulated image and one non-manipulate image). The creation component 1010 creates the composite image by combining individual images of the manipulated image set. The composite image can be sent from the housing that incorporates the system 1000 to the handheld device 430 along the physical link 440. While shown as part of the system 1000, the detonation component 410, the image acquisition component 420, and/or the creation component can be part of the handheld device 430.

In one embodiment, the image acquisition component 420 can include a rotatable camera (e.g., fish-eye camera). At a first instance in time the camera captures a first image from a first position and at a second instance in time (different from the first instance in time) the camera captures a second image from a second position (different from the first position). The first image and the second image can have an overlap. This overlap can be useful to ensure that gaps do not occur among the plurality of images and/or to increase resolution in the composite image. Therefore, when individual images are stitched together, stitching can be performed more easily since common references can exist among images (e.g., a common item in two pictures due to the overlap). In addition, some of the overlap may have inconstancies. For example, an object in overlapped portions can move from the first instance in time to the second instance in time. In view of this, the first image and/or the second image can be manipulated so the object does not appear as distorted in the composite image. In one embodiment, if a problem among individual images of the plurality of images cannot be rectified (e.g., manipulation cannot successfully correct a discrepancy among images), then the image acquisition component 420 can capture one or more images (e.g., capture an image of an area from which the discrepancy arises).

Figure 11:
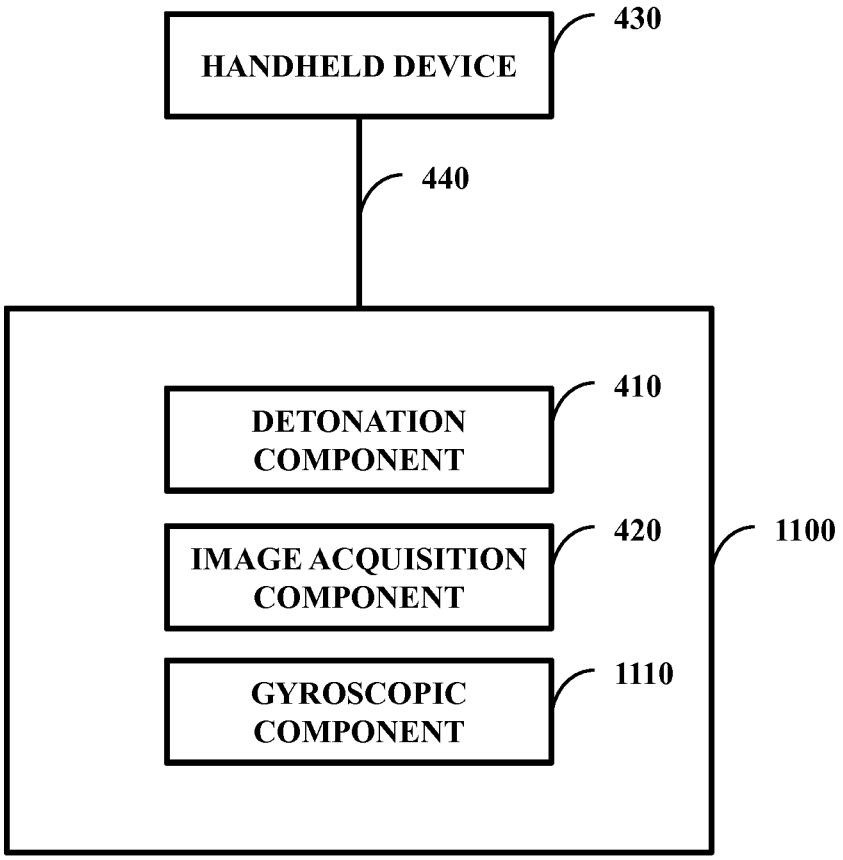
FIG. 11 illustrates on embodiment of a system comprising the detonation component, the image acquisition component, and a gyroscopic component.

FIG. 11 illustrates on embodiment of a system 1100 comprising the detonation component 410, the image acquisition component 420, and a gyroscopic component 1110.

A handheld housing (e.g., acrylic housing) retains a camera and the gyroscopic component 1110. The handheld housing can connect to the handheld device 430 by way of the physical link 440. The handheld housing can also retain the detonation component 410, the image acquisition component 420, and other components disclosed herein along with the gyroscopic component 1110. After the handheld housing is deployed, the gyroscopic component 1110 is configured to stabilize the handheld housing while the camera captures the plurality of images (e.g., through use of counterbalancing weights), where the image acquisition component 420 causes the camera to capture the plurality of images. In one embodiment, the gyroscopic component 1110 can stabilize proactively (e.g., without instruction) when a criterion is met and/or in response to identification of a stabilization instruction (e.g., sent from the handheld device 430). For example, the stabilization instruction can be entered into the interface 140 of FIG. 1.

Figure 12:
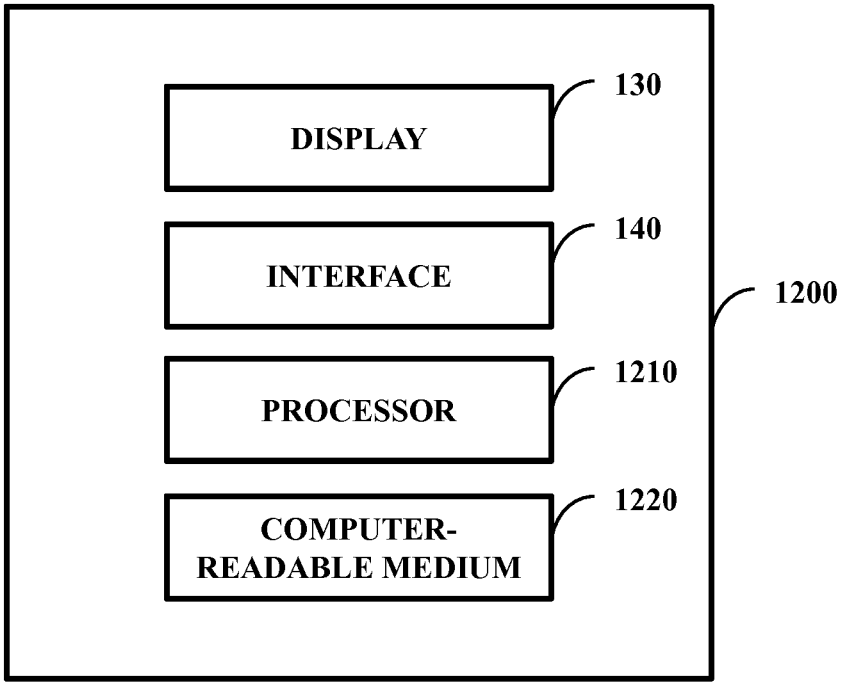
FIG. 12 illustrates one embodiment of a handheld device comprising the display, the interface, a processor, and a computer-readable medium.

FIG. 12 illustrates one embodiment of a handheld device 1200 comprising the display 130, the interface 140, a processor 1210, and a computer-readable medium 1220 (e.g., a non-transitory computer-readable medium).

The interface 140 is configured to obtain an input (e.g., an input from a user) while the display 130 is configured to display a compound image. The interface 140 and display 130 can function as a single unit (e.g., as a smart phone screen, such as a screen that enables zoom features through two-finger touch). The compound image is an image stitched from a plurality of images, where the compound image is of a higher resolution level then a resolution level of individual images of the plurality of image. The plurality of images are obtained from a grenade (e.g., a grenade that functions as the projectile 180 of FIG. 1 that can be launched from a grenade launcher) tethered by physical link to the handheld device 1200.

The handheld device 1200 also comprises the computer-readable medium 1220 configured to store computer-executable instructions that when executed by the processor 1210 cause the processor 1210 to perform a method. In one embodiment, the method comprises performing an analysis of the input, making a determination on if the input is an instruction to cause an ordnance of the grenade to detonate (e.g., the determination is based, at least in part, on a result of the analysis), and causing the ordnance of the grenade to detonate (e.g., send a detonation instruction signal from the handheld device 1200 to the grenade) in response to the input being the instruction to cause the ordnance of the grenade to detonate.

For example, a police officer for a SWAT (special weapons and tactics) team can throw a concussion grenade in a room, view a stitched images produced from images captured by the concussion grenade, and place an input for the concussion grenade to detonate. The input is analyzed and identified as a command for the concussion grenade to detonate. If a stop condition does not exist (e.g., a friendly RFID tag is identified near the grenade), then a signal can be sent to the concussion grenade for an ordnance of the concussion grenade to detonate.

In one embodiment, the interface 140 is configured to present a command portion. The command portion can be used to command operation of the grenade. For example, the command portion can be configured to direct movement of the grenade, control when images are captured from the grenade, control how images are captured from the grenade (e.g., control focus of the camera), control which camera to use (e.g., a digital camera or a thermal camera), and others.

In one example, a soldier can send a smoke grenade into a room. However, the smoke grenade can land in a location that obstructs the view of at least one camera of the smoke grenade. The smoke grenade can be equipped with movement capabilities (e.g., wheels). The smoke grenade can receive movement commands from the handheld device 1200 (e.g., by way of the interface 140) and follow those commands such that the smoke grenade is no longer obstructed.

In one embodiment, the grenade (e.g., functioning as the projectile 180 of FIG. 1) can include a self-correction capability. For example, a camera of the grenade can take a photograph and the grenade can include a component (e.g., the evaluation component 620 of FIG. 6) to evaluate the photograph. A determination can be made by way of the processor 1210 that the camera is blocked. The grenade can first attempt to move the camera and determine if the camera is still blocked. If the camera is still blocked, then the grenade can attempt to move to an unblocked location (e.g., perform at least one move and check action). Once in an unblocked location, the grenade can capture the images and the images can be sent to the handheld device 1200 for stitching or stitching occurs at the grenade and the stitched image is received by the handheld device 1200. For example, the processor 1210 can be used in processing the individual images for use in a stitching algorithm.

Figure 13:
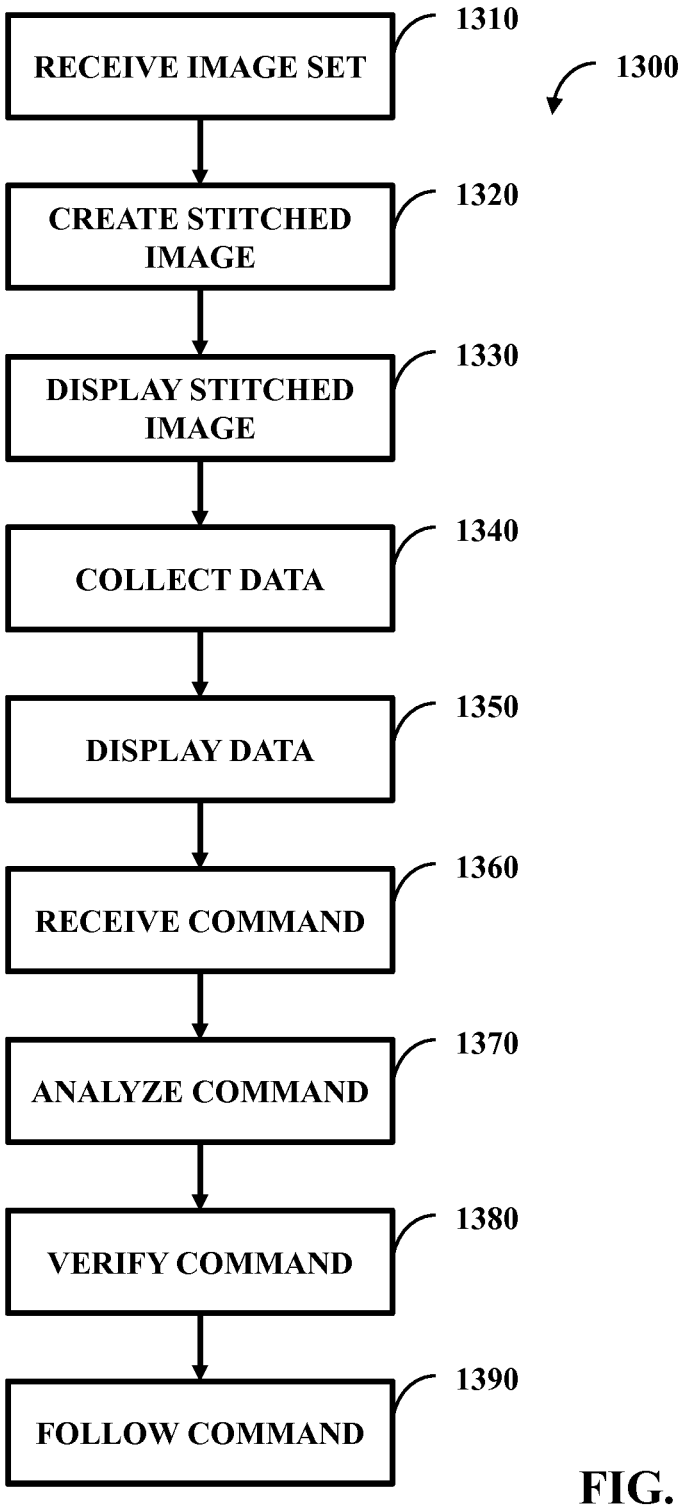
FIG. 13 illustrates one embodiment of a method that can be performed by the processor.

FIG. 13 illustrates one embodiment of a method 1300 that can be performed by the processor 1210 of FIG. 12.

At 1310 an image set (e.g., one or more images) can be received (e.g., from the projectile 180 of FIG. 1), stitched together into a stitched image at 1320, and the stitched image is displayed at 1330. In one embodiment, the stitched image can be in the image set received at 1310 and then displayed at 1330 without stitching at 1320. Data can be collected about the stitched image at 1340 and this data is displayed at 1350 (e.g., such that the stitched image and data are displayed concurrently). Example data can include identifiers of individuals shown in the stitched image, coordinate information of the stitched image, time data of when images were take upon which the stitched image is based, etc. A person can enter a command (e.g., by way of the display 130 of FIG. 1 and/or the interface 140 of FIG. 1). This command can be received at 1360 and be analyzed at 1370 (e.g., by the analysis component 150 of FIG. 1). The command can be verified at 1380 and then be followed at 1390.

In one example, a user can enter a command to have more images taken and for another stitched image to be produced. This command can be received and analyzed to determine what is being requested. The command can be verified to make sure that what is being requested can be followed, that the determination is accurate, etc. An instruction can be created based on this determination (e.g., through use of the processor 1210 of FIG. 12) and the command can be followed by sending the instruction (e.g., to the projectile 180 of FIG. 1).

Figure 14:
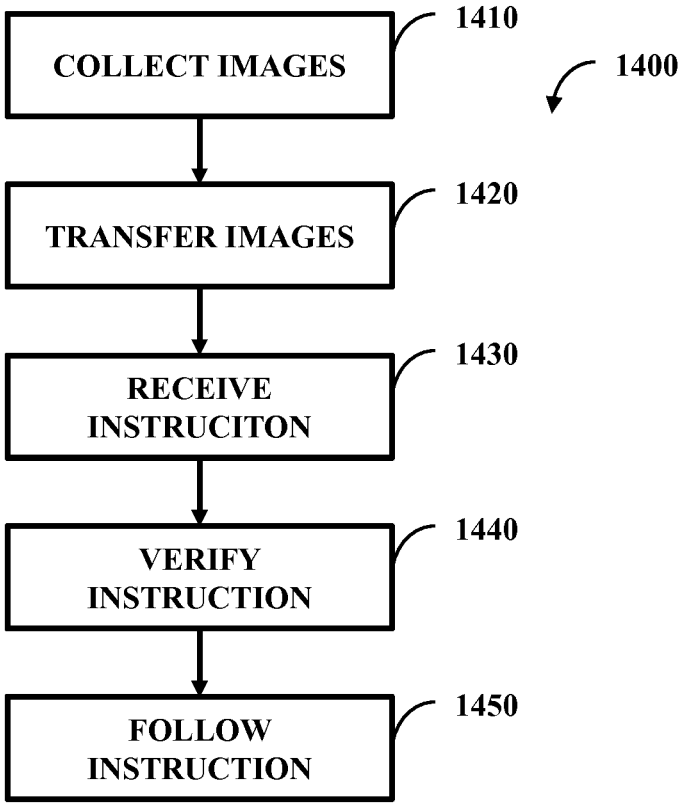
FIG. 14 illustrates one embodiment of a method that can be performed by the processor.

FIG. 14 illustrates one embodiment of a method 1400 that can be performed by the processor 1210 of FIG. 12.

In one embodiment, the processor 1210 of FIG. 12 and the computer-readable medium 1220 of FIG. 12 can both be part of the projectile 180 of FIG. 1. The projectile 180 of FIG. 1 can collect images at 1410 and transfer the images at 1420. The images can be transferred after the images are collected or while images are being collected (e.g., a first image is taken and while a second image is taken the first image is transferred.) In one embodiment, the images collected at 1410 are stitched together at the projectile 180 of FIG. 1 and then the stitched image is transferred at 1420. After transferring the images, the projectile 180 of FIG. 1 can wait to receive an instruction or perform at least one other function (e.g., gather more images, gather data such as location and/or voice data, etc.). The instruction (e.g., an instruction to detonate a specific ordnance of the projectile 180 of FIG. 1) can be received at 1430 and verified at 1440. The verification can include determining that the instruction came from an authorized source. Upon verifying the instruction, the instruction can be followed at 1450.

The method 1400 and the method 1300 of FIG. 13 can function together. For example, the method 1300 of FIG. 13 can function on the handheld device 1200 of FIG. 12 while the method 1400 can function on the projectile 180 of FIG. 1 that is tethered to the handheld device 1200 of FIG. 12 (e.g., tethered by way of the physical link 190 of FIG. 1). In one example, the images that are transferred at 1420 can be the same images that are received at 1310 of FIG. 13. In another example, following the command at 1390 causes the instruction to be sent that is received at 1430.

Various components disclosed herein can perform different tasks and different features can be used for various aspects disclosed herein. The projectile 180 of FIG. 1 can be reusable, such as by having a replaceable flash ordnance compartment that can be refilled with flash cartridges and be deployed with a primary goal of surveillance and a secondary goal of detonation. The projectile 180 of FIG. 1 can be at least partially hidden in an area of an environment that an enemy may visit and then an ordnance of the projectile 180 of FIG. 1 can be detonated when the enemy is the area (e.g., the projectile 180 of FIG. 1 is placed in a waiting situation).

Aspects disclosed herein can be used in various environments. Dismounted soldiers can use aspects disclosed herein to learn more about their immediate surroundings (e.g., learn what is in hidden areas such as buildings or caves) and detonate the grenade if desired. Aspects disclosed herein can be used to provide controlled detonation of ordnance placed in a location that may eventually have enemy activity or uses by police. For example, aspects can be used to combat criminals or be used in hostage situations.

In addition to police, hunters can also use aspects disclosed herein, such as using the projectile 180 of FIG. 1 to look into a bear's cave to determine if a bear is present in the cave. The projectile 180 of FIG. 1 can be used as a probe into areas where humans cannot reach such as tunnels, pipes, or caves, as well as areas that are hazardous to humans (e.g., radiation, toxic gases, etc.). The projectile 180 of FIG. 1 can be outfitted with a sensor, such as a radiation detector and/or the projectile 180 of FIG. 1 can include a sampling device and once a sample is taken the projectile 180 of FIG. 1 can be retrieved by way of the physical link 190 of FIG. 1. The projectile 180 of FIG. 1 can be used in demolition activities. For example, the interface 140 of FIG. 1 can be used to control the projectile 180 of FIG. 1 such that the projectile 180 of FIG. 1 is moved to a precise position that can facilitate improved (e.g., optimal) demolition (e.g., place projectile 180 of FIG. 1 at a load bearing point of a building). The projectile 180 of FIG. 1 can include various features (e.g., audio sensors, an infrared camera, and infrared illuminator, a chemical sensor, radiation sensor, physical sensor collection device, a non-explosive self-destruct component).

In addition, the projectile 180 of FIG. 1 can communicate with the system 100 of FIG. 1 by way of wireless communication (as opposed to the physical link 190 of FIG. 1) and vice versa. The handheld device 310 of FIG. 3 can communicate with the explosive ordnance device 300 of FIG. 3 by way of wireless communication (as opposed to the physical link 320 of FIG. 3) and vice versa. The handheld device 1200 of FIG. 12 can communicate with the grenade by way of wireless communication (as opposed to the physical link) and vice versa.

While discussed as related to explosives (e.g., such as practicing aspects with regard to the grenade), aspects disclosed herein can be applied to other areas. For example, a baseball can retain an image camera and transmit individual images to a broadcaster that can use those images in the broadcast (e.g., the individual images, a stitched image from the individual images, etc.). Other applications for aspects disclosed herein can include deep-sea or space exploration, spying, movie making, and others.

What is claimed is:

1. A system, comprising:

a detonation component configured to cause an ordnance to detonate;

an image acquisition component configured to cause a capture of a plurality of images; and a radio frequency identification component configured to:

identify a radio frequency identifier information set;

evaluate the radio frequency identifier information set to produce an evaluation result; and make a determination on if the ordnance should detonate based, at least in part, on the evaluation result, where the detonation component causes the ordnance to detonate in response to the determination being that the ordnance should detonate, where the radio frequency identification component is configured to prevent the detonation component from causing the ordnance to detonate when a detonation instruction is identified for the ordnance and when the determination is that the ordnance should not detonate.

2. The system of claim 1, where a housing retains the ordnance, where the plurality of images are sent from the housing to the handheld device by way of the physical link, and where individual images of the plurality of images are visual images.

3. The system of claim 2, comprising:

a sensor component configured to obtain a contextual information set, where the housing retains the sensor component and where the contextual information set is information about surroundings of the housing after deployment; and a sensor analysis component configured to analyze the contextual information set to produce a sensor analysis result;

a setting selection component configured make a selection of a setting set for the image acquisition component, where the selection of the setting set is based, at least in part, on the sensor analysis result; and an implementation component configured to cause the capture of the plurality of images to occur in accordance with the setting set.

4. The system of claim 1, comprising:

an obtainment component configured to obtain an operator instruction from the handheld device by way of the physical link;

an evaluation component configured to perform an evaluation of the operator instruction; and an instruction component configured to make a determination on if the operator instruction is to cause the ordnance to detonate, where the determination is based, at least in part, on a result of the evaluation, where the detonation component is configured to cause the ordnance to detonate in response to the determination being that the operator instruction is to cause the ordnance to detonate, where a housing retains the obtainment component, where the housing retains the evaluation component, and where the housing retains the instruction component.

5. The system of claim 2, where the plurality of images cover an area of about 360 degrees around the housing, where the handheld device is configured to perform an image stitch of the plurality of images to create a composite image and where the composite image covers the area of about 360 degrees around the housing.

6. The system of claim 1, where the plurality of images are captured by use of a light illumination and where the light illumination is of a level sufficient to cause at least partial visual impairment to a person.

7. The system of claim 1, where the radio frequency identifier information set is that a person without an authorized radio frequency identification tag is handling the ordnance and where the determination is that the ordnance should detonate because the person without the authorized radio frequency identification tag is handling the ordnance.

8. The system of claim 1, comprising:

a creation component configured create a composite image, where a housing retains the creation component, where the housing retains the detonation component, where the housing retains the image acquisition component, where the creation component employs an algorithm to create the composite image, where the algorithm is configured to manipulate at least one individual image of the plurality of images to produce a manipulated image set, and where the creation component creates the composite image by combining individual images of the manipulated image set.

9. The system of claim 1, comprising:

a gyroscopic component configured to stabilize a housing while a camera captures the plurality of images, where the housing retains the gyroscopic component, where the housing retains the camera, where the housing is a handheld housing, and where the image acquisition component causes the camera to capture the plurality of images.

10. The system of claim 1, comprising:

a self-correction component, where a housing retains the self-correction component, the detonation component, the image acquisition component, and the radio frequency identification component, the self-correction component is configured to:

make a determination that the housing is in a non-desired position; and cause a movement of the housing to a desired position when the determination is that the housing is in the non-desired position, where the image acquisition component functions, at least in part, after the movement of the housing to the desired position.

11. The system of claim 10, where the movement of the housing comprises a movement of the housing itself.

12. The system of claim 10, where the movement of the housing comprises a movement of a camera retained in the housing.

13. The system of claim 1, comprising:

a selection component configured to select a camera for use capture of the plurality of images, where selection is made from a first camera, a second camera, or a combination thereof, where the first camera and the second camera are different camera types, where the housing retains the first camera, where the housing retains the second camera, and where the image acquisition component captures the plurality of images, at least in part, through use of the camera that is selected.

14. The system of claim 1, where the detonation component, the image acquisition component, and the radio frequency identification component, and the ordnance are retained in a housing.

15. The system of claim 1, where the detonation instruction is provided from a user by way of the handheld device.

16. A handheld device, comprising:

a display configured to display a compound image, where the compound image is an image stitched from a plurality of images, where the compound image is of a higher resolution level then a resolution level of individual images of the plurality of images and where the plurality of images are obtained from an grenade tethered by a physical link to the handheld device;

an interface configured to obtain an input and configured to present a command portion, where the command portion is configured to direct movement of the grenade;

a processor; and a computer-readable medium configured to store computer-executable instructions that when executed by the processor cause the processor to perform a method, the method comprising:

performing an analysis of the input;

making a determination on if the input is an instruction to cause an ordnance of the grenade to detonate, where the determination is based, at least in part, on a result of the analysis; and causing the ordnance of the grenade to detonate in response to the input being the instruction to cause the ordnance of the grenade to detonate.

17. The system of claim 16, where the movement is directed after the grenade is deployed and while the grenade is non-airborne.

18. A method, performed at least in part by a projectile with an ordnance and an image capture component, comprising:

collecting an image set comprising a first image and a second image;

transferring the image set to a handheld device, where an image, based at least in part on the image set that is transferred, is presented on a display of the handheld device;

receiving a remote control movement command from the handheld device; and causing movement of the projectile in accordance with the remote control movement command.

19. The method of claim 18, comprising:

collecting a third image; and identifying that the third image is not appropriate for the stitched image, where the image is a stitched image of the first image with the second image, where the third image is a replacement image for the first image, where the third image is collected before the first image, and where the remote control movement command is a command to move the projectile such that the first image is an improved image over the third image.

20. The method of claim 18, where transferring the image set to a handheld device occurs wirelessly.

* * * * *